United States Patent [19]

Moulin

[11] Patent Number: 4,967,518

[45] Date of Patent: Nov. 6, 1990

[54] FIBER OPTIC TERMINUS GRINDING AND POLISHING MACHINE

[75] Inventor: Norbert L. Moulin, Placentia, Calif.

[73] Assignee: Hughes Aircraft Company, Los Angeles, Calif.

[21] Appl. No.: 369,411

[22] Filed: Jun. 16, 1989

Related U.S. Application Data

[62] Division of Ser. No. 267,962, Nov. 7, 1988, Pat. No. 4,905,415.

[51] Int. Cl.[5] ..... B24B 1/00

[52] U.S. Cl. ..... 51/281 R; 51/326; 51/125.5

[58] Field of Search ..... 51/124 R, 125.5, 326, 51/283 R, 284 R, 281 R

[56] References Cited

U.S. PATENT DOCUMENTS

| | | | |
|---|---|---|---|
| 2,511,449 | 6/1950 | Springman | 51/122 |
| 2,603,041 | 7/1952 | Bowen | 51/166 MH |
| 3,841,031 | 10/1974 | Walsh | 51/283 |
| 4,536,992 | 8/1985 | Hennenfent | 51/109 R |

*Primary Examiner*—Frederick R. Schmidt
*Assistant Examiner*—Jack W. Lavinder
*Attorney, Agent, or Firm*—Joseph E. Szabo; Wanda K. Denson-Low

[57] ABSTRACT

A grinding and polishing machine (11) which includes a grinding section (15), a polishing section (17), a fixture (19) and a fixture bearing assembly (21). Fiber optic termini (169) are retained in the fixture (19) so that distal ends (185) of optical fibers (177) and end faces (181) can be ground by a grinding abrasive (80) and polished by a polishing abrasive (91). The distal ends (185) and the end faces (181) prevent contact between the fixture (19) and the grinding abrasive (80) and the polishing abrasive (91).

3 Claims, 7 Drawing Sheets

55a
61a
79a
35a
105
61a
80a
95
59a
71a
33a
69a
93a
43a
57a
27
49a
23
45a
109
VAC
29a
107
39a
197
45a
37a
193
199
195
196
169
157
159
153
191
213
211
205
203
210
201

FIBER OPTIC TERMINUS GRINDING AND POLISHING MACHINE

This is a division of application Ser. No. 267,962, filed Nov. 7, 1988 now U.S. Pat. No. 4,905,415

BACKGROUND OF THE INVENTION

1. Field of the Invention

This invention relates to a grinding and polishing machine and, more particularly, to a machine for grinding and polishing fiber optic termini.

2. Description of Related Art

A fiber optic terminus typically includes a housing and an optical fiber extending through the housing. It is important that the distal end of the fiber be flush with an end face of the housing and that the plane of the distal end be perpendicular to the longitudinal axis of the fiber. Accuracy is very important, and tolerances may be, for example, plus or minus 0.0002 inch.

At one stage in the manufacture of a fiber optic terminus, the optical fiber extends through the housing, and a projecting segment of the optical fiber extends beyond the end face of the housing and terminates in a distal end. For example, the projecting segment may have a length of approximately 0.030 inch. It is necessary to very accurately grind off the projecting segment so that the distal end of the optical fiber is flat, flush with the end face and perpendicular to the longitudinal axis of the fiber. The end face of the housing should also be perpendicular to the axis of the fiber, and the distal end of the fiber should have an optical finish.

It is known to position a group of fiber optic termini in a fixture and to accomplish the grinding and polishing by manually holding the fixture and the fibers against grinding and polishing wheels. This requires a skilled operator and is fatiguing to the operator. Automated equipment is also available for holding a fixture with one or more fiber optic termini against grinding and/or polishing wheels.

A primary problem with all of these prior art techniques is that, at some point during the grinding operation, the fixture which holds the fiber optic termini is brought into contact with the abrasive used for the grinding operation. The abrasive contact between the abrasive and the fixture causes the fixture to wear relatively rapidly. To reduce wear on the fixture, it is known to use hard diamond pads on the fixture and a softer abrasive, such as aluminum oxide. However, this relatively softer abrasive is not the most effective abrasive for the grinding operation, and the time required for the grinding operation is increased.

A problem associated with automating of the grinding and polishing operations is in the construction of a grinding and polishing apparatus with sufficient accuracy to yield the precision results required. More specifically, the problem is in obtaining the very accurate parallel and perpendicular relationships required for precision grinding and polishing of fiber optic termini. For example, in a precision grinding apparatus, the rotational axes of the grinding and polishing abrasives should be parallel, and the abrasives must be perpendicular to the axes about which the abrasives rotate.

SUMMARY OF THE INVENTION

This invention generally overcomes the problems noted above. More specifically, this invention provides a method and apparatus which accurately carries out the grinding and polishing functions without bringing the fixture into contact with the abrasive. Consequently, a hard diamond abrasive can be used so that the grinding operation can be carried out rapidly, and no wear is experienced by the fixture. In addition, this invention provides for the accurate construction of a grinding and polishing apparatus such that substantial precision is obtainable with an automated process.

According to one method feature of this invention, a plurality of the termini is placed into a fixture with the termini projecting from a wall of the fixture such that the distal ends of the termini are spaced from the wall and the projecting segments of the optical fibers extend beyond the wall. The distal ends of the projecting segments are contacted with an abrasive, and the abrasive and the termini are relatively moved without bringing the fixture into contact with the abrasive to substantially remove the projecting segments so that the optical fibers are substantially flush with the associated end faces of the terminus. If desired, some of the material of the end faces of the terminus can also be removed.

The termini project from the wall of the fixture sufficiently so that, when the grinding and polishing operations are completed, a length of each terminus still projects from the fixture wall. Consequently, the termini, even in its finished condition, separates the fixture from the abrasive, and the abrasive, whether it be for grinding or polishing, does not contact the fixture during the grinding and polishing operations.

The relative movement between the abrasive and the termini can be the result of moving one or both, the abrasive and the termini. Preferably, the abrasive is rotated about a rotational axis, and the fixture and termini are oscillated about an oscillation axis and move toward the abrasive to bring the terminus end into contact with the abrasive.

This invention is applicable to grinding and/or polishing of fiber optic termini. Preferably, both grinding and polishing are carried out, and this can be accomplished, for example, by providing both grinding and polishing abrasives on separate abrasive carriers and moving the fixture from the grinding abrasive to the polishing abrasive after the grinding operation has been completed. To facilitate changing of the abrasive, differential fluid pressure, e.g., subatmospheric pressure, can be used to releasably retain one or both of the abrasives on the abrasive carrier. Typically, this is a more suitable technique for retaining the polishing abrasive.

A variety of fixtures for holding the termini in a way to preclude contact between the fixture and the abrasive can be used. However, a preferred fixture includes a first fixture member having passages extending therethrough for receiving the termini, respectively, with the termini extending beyond the first fixture member, and a second fixture member having a wall with passages extending therethrough. The first fixture member has means for releasably retaining the termini in the associated passages. The first fixture member is releasably mounted on the second fixture member with at least some of the passages of the second fixture member being in registry with the passages of the first fixture member so that the termini can project through and beyond the wall. Preferably, the second fixture member has a recess which receives the first fixture member, and the wall forms at least a part of an end wall of the recess.

The fixture preferably has radially tapered surfaces in the passages, respectively, for use in axially positioning the termini. This tapered surface coacts with a correspondingly tapered surface on the associated terminus to help axially position the terminus, and these coacting surfaces tend to exclude debris from entering the region between the terminus and the fixture. Biasing means is preferably used for biasing the terminus against the associated tapered surface, and the biasing means helps to accommodate tolerance variations.

Another feature of this invention is the use of a base member having a lapped surface and keying all critical relationships off the lapped surface. By doing this, the rotational axes of the grinding and polishing abrasives and the axis of oscillation of the fixture can be made parallel to each other and perpendicular to the lapped surface.

One way to implement this feature of the invention is for the machine to include grinding, polishing and fixture-arm bearing assemblies with each of the assemblies including a housing, a shaft and bearing means for mounting the shaft on the housing for rotational movement. At least one, and preferably all, of the housings have a machined face which is substantially perpendicular to the rotational axis of the associated shaft. The bearing assemblies are mounted on the base member, with the machined faces positioned against the lapped surface so that the rotational axes of the grinding and polishing assemblies and the oscillation axis of the fixture-arm bearing assembly will be parallel and perpendicular to the lapped surface. Abrasive carriers are mounted on the shafts of the grinding and polishing bearing assemblies, and a fixture arm is mounted on the fixture-arm bearing assembly so the fixture arm can pivot between abrasive carriers, oscillate over each of the abrasive carriers and be moved axially toward and away from each of the abrasive carriers.

At least one and preferably both, of the abrasive carriers includes a platen having a machined mounting surface which is perpendicular to the rotational axis of the shaft of the associated bearing assembly. This machined surface can be used in various ways to attach and/or control the position of an abrasive carried by such abrasive carrier. In a preferred construction, at least one, and preferably both, of the abrasive carriers also includes a disc, resilient means for urging the disc away from the platen and stop means associated with the machined mounting surface for limiting the amount that the disc can be urged away from the platen. The resilient means can accurately urge the disc against the stop means, the position of which is accurately controlled by the machined mounting surface.

According to a preferred method, the machined face of each of the housings can be provided by rotating the housing about the rotational or oscillation axis defined by the associated shaft and machining the face of the housing during such rotation so that the face is perpendicular to the rotational axis. Also, the machined mounting surface can be provided by attaching the platen to the shaft and rotating the shaft and the platen together while machining the mounting surface of the platen so that the mounting surface is perpendicular to the rotational axis of the associated shaft.

The invention, together with additional features and advantages thereof, may best be understood by reference to the following description taken in connection with the accompanying illustrative drawing

BRIEF DESCRIPTION OF THE DRAWINGS

In the accompanying drawings

DESCRIPTION OF THE PREFERRED EMBODIMENT

Figure 1:
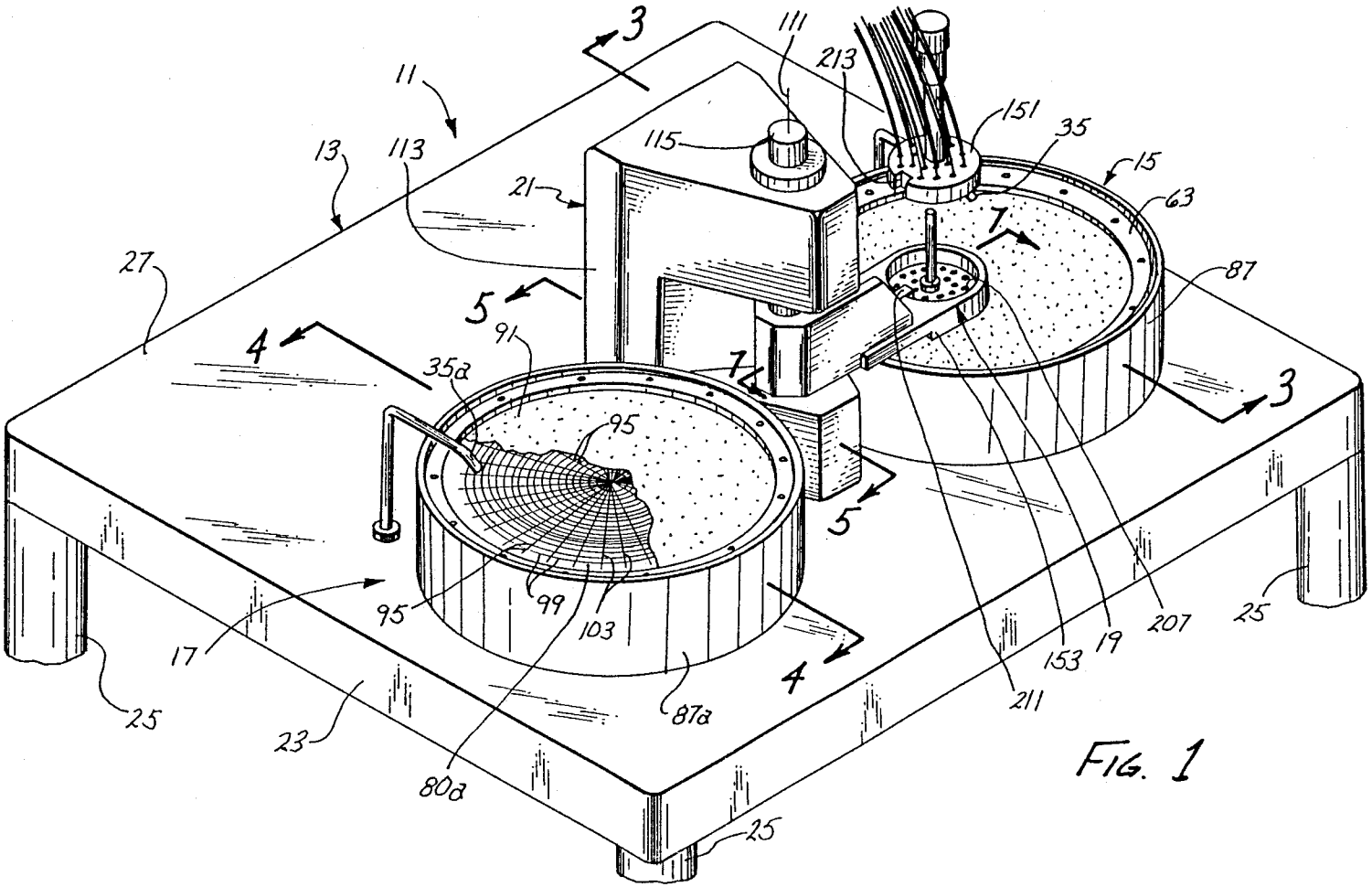
FIG. 1 is a fragmentary isometric view illustrating one preferred form of grinding and polishing machine of this invention.

Referring now to the drawings in more detail, FIG. 1 shows a machine 11 for grinding and polishing fiber optic termini which generally comprises a supporting structure 13, a grinding station or section 15, a polishing station or section 17, a fixture 19 and a fixture bearing assembly 21. Although the supporting structure 13 can take various different forms, in this embodiment, it is in the form of a table having a horizontal table top or base member 23 and a plurality of legs 25 for supporting the base member above a supporting surface (not shown), such as the floor. The base member 23 has an upwardly facing lapped surface 27 which has been accurately lapped so that it is very flat, planar and horizontal. For example, the lapped surface 27 may have a flatness of 0.0002 inch total indicator reading. As described more fully hereinbelow, all of the critical relationships are keyed off the lapped surface 27.

The grinding station 15 (FIGS. 1 and 3) includes a bearing assembly 29, an abrasive carrier 31, a housing 33, lubricant supply nozzle 35, a drive motor 37 and a motor mount 39. The bearing assembly 29 includes a housing 41, a shaft 43 and bearings 45 for mounting the shaft on the housing for rotational movement. The housing 41 has an annular flange 47, and the flange has a downwardly facing accurately machined face 49. The housing 41 extends through a bore 51 in the base member 23, and the machined face 49 rests on and directly contacts the lapped surface 27. Screws 53 (only one being shown in FIG. 3) extend through the flange 47 and into the base member 23 to attach the bearing assembly 29 to the base member 23.

The machined face 49 is accurately machined so that it is in a plane which is perpendicular to a rotational axis 55 of the shaft 43, with the rotational axis coinciding with the longitudinal axis of the shaft. Accordingly, the rotational axis 55 is perpendicular to the lapped surface 27.

Although the machined face 49 may be made perpendicular to the rotational axis 55 in different ways, this can be accurately accomplished by rotating the housing 41 about the shaft 43 and the rotational axis 55 and machining the face 49 during such rotation so that the face is perpendicular to the rotational axis.

The abrasive carrier 31 includes a platen 57 mounted on the shaft 43, a disc 59, resilient means in the form of springs 61 and an annular stop or retainer 63. The platen 57 has a tapered central bore 65 which receives a correspondingly tapered end portion of the shaft 43 and is affixed to the shaft in any suitable manner, such as by a retaining screw 67. The platen 57 has a peripheral wall 69 which terminates upwardly in a machined, annular mounting surface 71 which is perpendicular to the rotational axis 55 and an end wall 73 through which the bore 65 extends. The peripheral wall 69 and the end wall 73 define a basin or recess 75.

The retainer 63 contacts and rests on the mounting surface 71 and is attached to the platen 57 in any suitable manner, such as by screws 77 which extend into the peripheral wall 69. An inner annular portion of the retainer 63 extends radially inwardly of the peripheral wall 69 to define a ledge 79. The disc 59 and the spring 61 are received within the recess 75, and the springs urge the disc away from the platen 57 and, in particular, the end wall 73 thereof and into firm engagement with the ledge 79. The springs 61 have greater force than any force acting downwardly on the disc 59 during the grinding operation so that the disc always firmly contacts the ledge 79 and is positioned by the ledge.

A suitable grinding abrasive 80 is carried by the abrasive carrier 31, and, in particular, by the disc 59. For example, the grinding abrasive may form the upper or outer face of the disc 59. Preferably, the grinding abrasive is a suitable diamond abrasive known in the art for gem cutting faceting gems. In this embodiment, the abrasive 80 is perpendicular to the axis 55.

The abrasive carrier 31 rotates with the shaft 43 and is driven by the motor 37, which is coupled to the shaft 43 by a suitable coupling 81. The motor 37 is mounted on and beneath the base member 23 by the motor mount 39 in any suitable manner.

Figure 3:
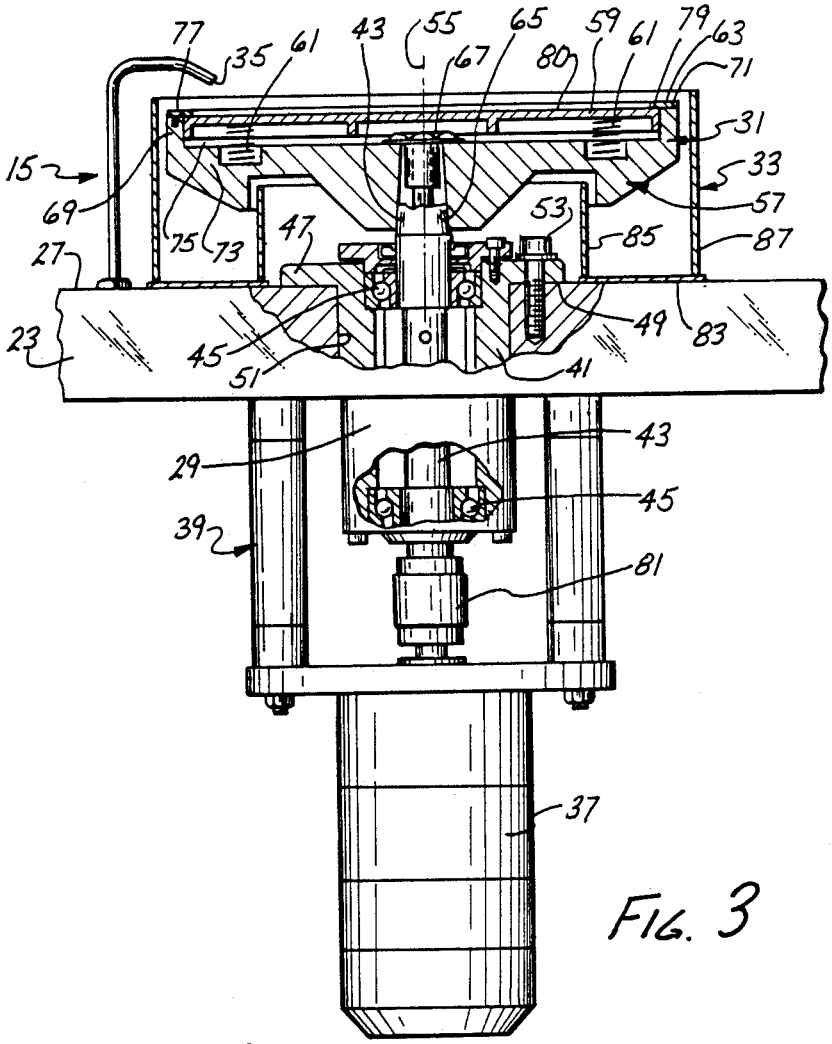
FIG. 3 is a sectional view partially in elevation taken generally along line 3—3 of FIG. 1 and illustrating the grinding section of the machine

The housing 33 includes a base 83 suitably attached to the base member 23 and inner and outer annular walls 85 and 87, respectively, which surround otherwise exposed rotatable portions of the abrasive carrier 31. Specifically, the outer wall 87 surrounds the peripheral wall 69 and extends slightly above it. As shown in FIG. 3, the nozzle 35 projects over the wall 87 so it can direct lubricant toward the outer periphery of the disc 59.

The polishing station 17 (FIGS. 1 and 4) in the illustrated embodiment is largely identical to the grinding station 15, and they are identical, except to the extent shown or described herein. Portions of the polishing station 17 corresponding to portions of the grinding station 15 are designated by corresponding reference numerals followed by the letter "a".

The primary difference between the polishing station 17 and the grinding station 15 is that the polishing station is adapted to retain a polishing abrasive 91, which may be in the form of a sheet which overlies an outer surface or abrasive supporting face **80*a*, utilizing differential fluid pressure and, more specifically, subatmospheric pressure. To accomplish this, the shaft 43*a* has a vacuum passage 93*a*, and the disc 59*a* has vacuum ports 95 (FIG. 1). The abrasive-supporting face 80*a* has a plurality of circumferentially extending grooves 99 (FIG. 1) and radial grooves 103 which are equally spaced circumferentially and which extend from the center of the disc to a location substantially at the periphery of the disc. Preferably, the vacuum ports 95 are formed at the intersections of the circumferential grooves 99 and selected ones of the radial grooves 103. For example, there may be four of the selected radial grooves 103 and they may extend from the center of the disc toward twelve o'clock, three o'clock, six o'clock, and nine o'clock positions at the disc periphery. Preferably, the grooves 99 and 103 are shallow to minimize the tendency of the vacuum pressure in the grooves to draw the polishing abrasive 91, which is relatively flexible, into the grooves to destroy the planar nature of the polishing abrasive. By locating the vacuum ports 95 at selected intersections of the grooves 99 and 103, the vacuum pressure can be evenly applied to the polishing abrasive 91**.

Leakage between the disc **59*a* and the peripheral wall 69*a* is precluded by an annular seal 105 carried by the disc 59*a*. Vacuum or subatmospheric pressure is applied from a vacuum source (not shown) through a conduit 107 (FIG. 4) and an opening 109 in the shaft 43*a* to the passage 93*a* and from there to the grooves 99 and 103 via the vacuum ports 95. With this construction, the polishing abrasive 91 is tightly retained against the outer surface 80*a*** by the subatmospheric pressure.

Because the bearing assembly **29*a* is manufactured and mounted in the same manner as the bearing assembly 29, the shaft 43*a* is perpendicular to the lapped surface 27 and parallel to the shaft 43. Similarly, the disc 59a and its abrasive-supporting face 80*a* are accurately positioned by the machined mounting surface 71*a*. Accordingly, the face 80*a* is perpendicular to the axis 55*a***.

The fixture 19 (FIGS. 1 and 5) is mounted for pivotal movement and vertical movement about an oscillatory axis 111 by the fixture bearing assembly 21 which includes a fixture arm housing 113, a fixture arm shaft 115 and bearing means in the form of bearings 117 for mounting the shaft 115 for axial and rotational movement along and about the axis 111. In this embodiment, the housing 113 is generally C-shaped or in the form of a yoke and has a machined face 119 that is perpendicular to the axis 111. The bearing assembly 21 is attached to the base member 23, with the face 119 being against the lapped surface 27 so that the axis 111 is perpendicular to the lapped surface and parallel to the rotational axes 55 and **55*a*. For example, the bearing assembly 21 may be attached to the base member 23 by threaded fasteners 121 (only one being shown in FIG. 5), which extend through a flange of the housing 113. The fixture 19 is mounted on the shaft 115** for movement with the shaft in any suitable manner, such as by a clamp, set screw, interference fit etc.

Figure 6:
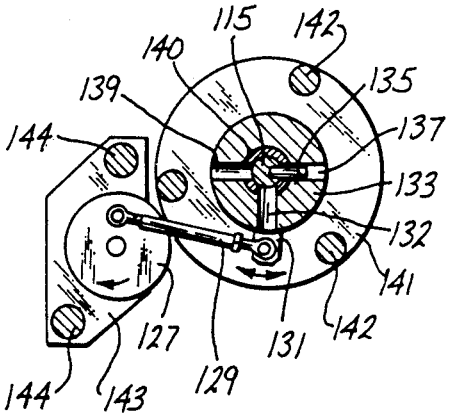
FIG. 6 is a sectional view taken generally along line 6—6 of FIG. 5 and showing the mechanism for oscillating the fixture arm.
Figure 5:
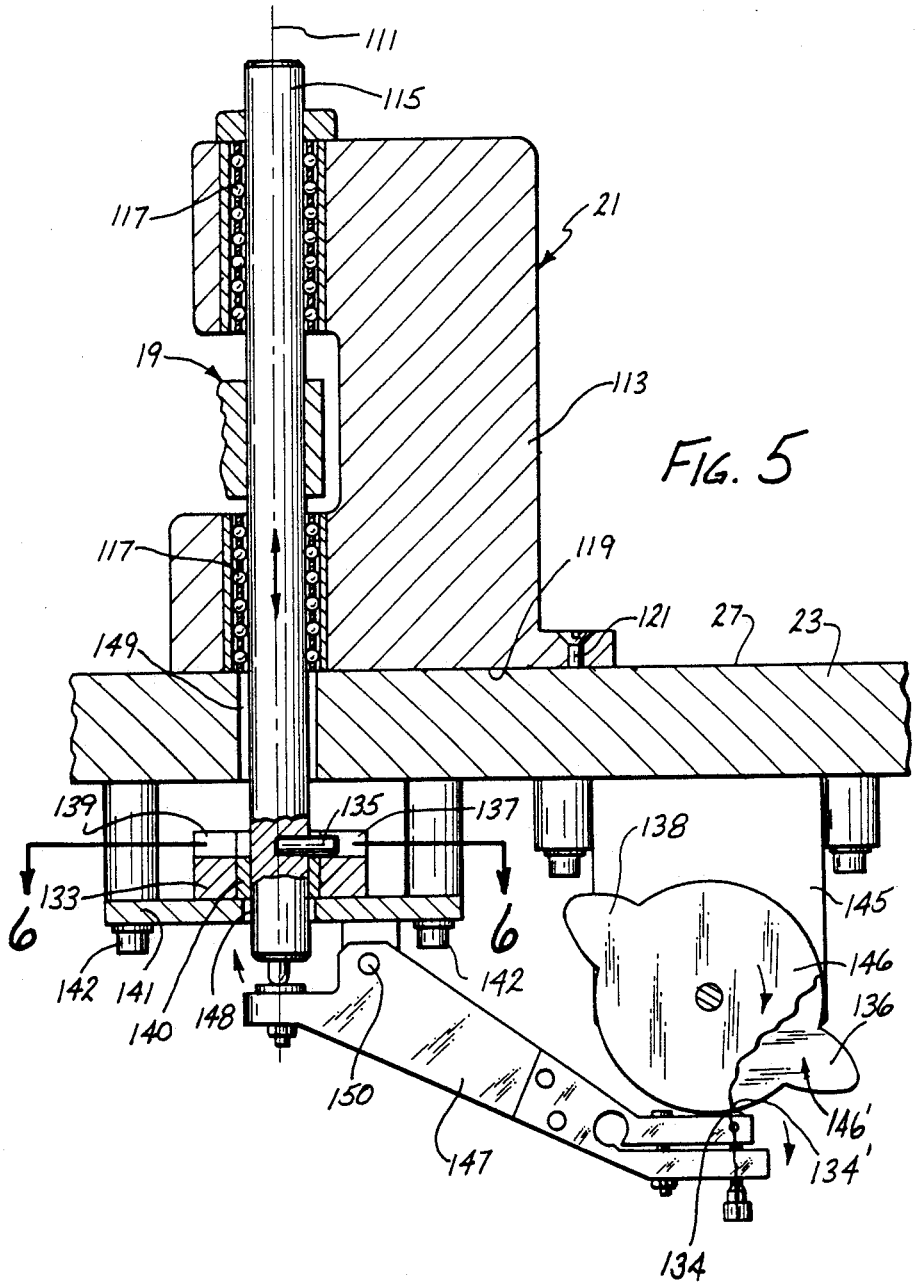
FIG. 5 is a sectional view taken generally along line 5-5 of FIG. 1 and illustrating the fixture arm section of the machine.

It is preferred to oscillate the fixture 19 over both the grinding station 15 and the polishing station 17. Although the oscillatory motion of the shaft 115 and the fixture 19 can be brought about in various different ways, one preferred construction is shown in FIGS. 5 and 6. A motor 125 (FIG. 2) drives a wheel 127 unidirectionally as shown by the arrow in FIG. 6, and a link 129 is pivotally coupled to both the wheel and a tab 131 on a collar 133 to thereby oscillate the collar 133 in a known manner. The shaft 115 is releasably drivingly coupled to the collar by a pin 135 receivable in any of three upwardly opening slots 132, I37 and 139 spaced 90 degrees apart on the collar 133. A sleeve bearing 140 is carried by the collar between the shaft 115 and the collar 133. Although various constructions are possible, in this embodiment, the collar 133 rests on a plate 141 which is attached to the base member 23 by a plurality of fasteners 142, and the wheel 127 is similarly mounted on the base member 23 by a plate 143 and fasteners 144. The motor 125 is mounted on the base member 23 in the same manner as the motor 37. Preferably, the link 129 is of adjustable length to thereby enable varying the length of the arc through which the shaft 115 oscillates.

It is also necessary to move the shaft 115 vertically so that the fixture 19 can be moved toward and away from the discs 59 and **59*a* of the grinding station 15 and the polishing station 17. This vertical movement controls the rate of feed during the grinding and polishing actions and also moves the fixture 19 substantially away from each of the discs 59 and 59*a* to facilitate movement of the fixture 19 between the stations 15 and 17**.

Although this can be accomplished in different ways, as shown in FIG. 5, it is accomplished by a feed motor 145 carried by the base member 23, a grinding cam 146, a polishing cam 146' which are rotated together on a shaft 132 by the motor 145 in a conventional manner, and a pivot arm 147 which bears at its opposite ends on the lower end of the shaft 115 and one or the other of the cams. The shaft 115 is allowed to move vertically by openings 148 and 149 in the plate 141 and the base member 23, respectively, and by a free-sliding fit within the bearing 140. Also, the pin 135 is receivable within the slots 132, 137 and 139 with sufficient looseness to allow axial movement of the shaft 115 along the axis 111. The bearings 117 serve to accurately guide this axial-vertical movement of the shaft 115.

More specifically, the pivot arm 147 is pivotable about a pivot axis 150, which lies intermediate its ends and has cam followers in the form of rollers 134 and 134' which are coupled to the arm 147 and which roll on the periphery of the grinding cam 146 and the polishing cam 146', respectively. The grinding cam 146 has a lobe 138 and the polishing cam 146' has a lobe 136. The cams 146 and 146' rotate slowly in fixed relationship to each other, and in this regard, a suitable gear reduction mechanism (not shown) may be interposed between the motor 145 and the cams 146 and 146'. The weight of the shaft 115 and the components affixed thereto tends to pivot the pivot arm 147 counterclockwise as viewed in FIG. 5 to maintain engagement between the rollers 134, 134' and the associated cams 146, 146'.

Figure 11:
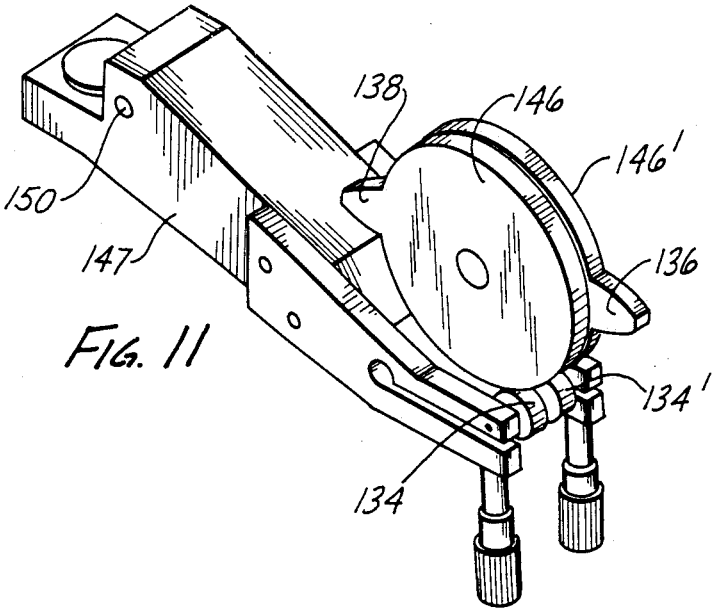
FIG. 11 is an isometric view of the cams and a portion of the related structure for controlling the feeding rate during the grinding and polishing operations with the cams being in a slightly different position from that illustrated in FIGS. 2 and 5.
Figure 12:
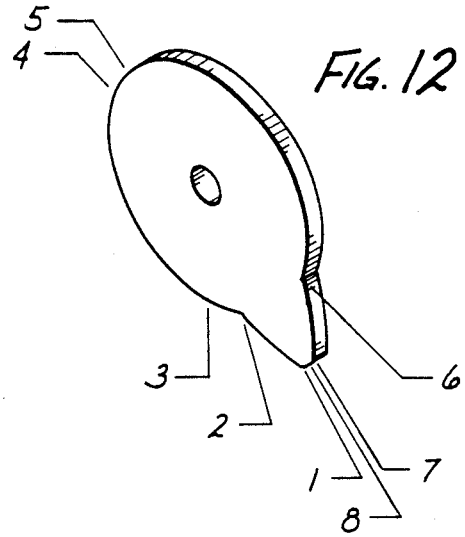
FIGS. 12 and 13 are perspective views of the polishing and grinding cams, respectively.
Figure 13:
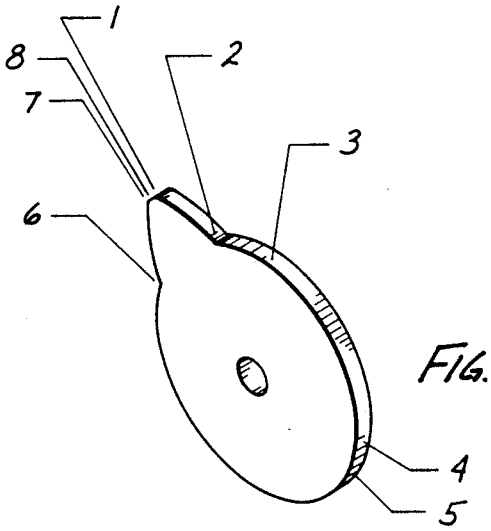

When the roller 134 contacts regions of the grinding cam 146 other than the lobe 138, it controls the rate of feed of the fixture 19 toward the disc 59 of the grinding station 15. During this same time, the periphery of the polishing cam 146' is spaced from the roller 134' so that the grinding cam 146 has sole control over the feeding motion during the grinding operation. Conversely, during the polishing operation, the roller 134' engages the polishing cam 146', and the roller 134 is spaced from the grinding cam 146 so that the polishing cam 146' has sole control of the rate of feed during the polishing operation. At the conclusion of the grinding operation, the grinding cam 146 has rotated to a position to bring its lobe 138 into contact with the roller 134. The lobe 138 pivots the pivot arm 147 clockwise as viewed in FIGS. 5 and 11 to lift the fixture 19 well above the grinding station 15. In this position, the pin 135 is within, but near the top of, the slot 137, and when the cam follower is at the top of the lobe 136, the motor 145 is automatically shut off.

Figure 2:
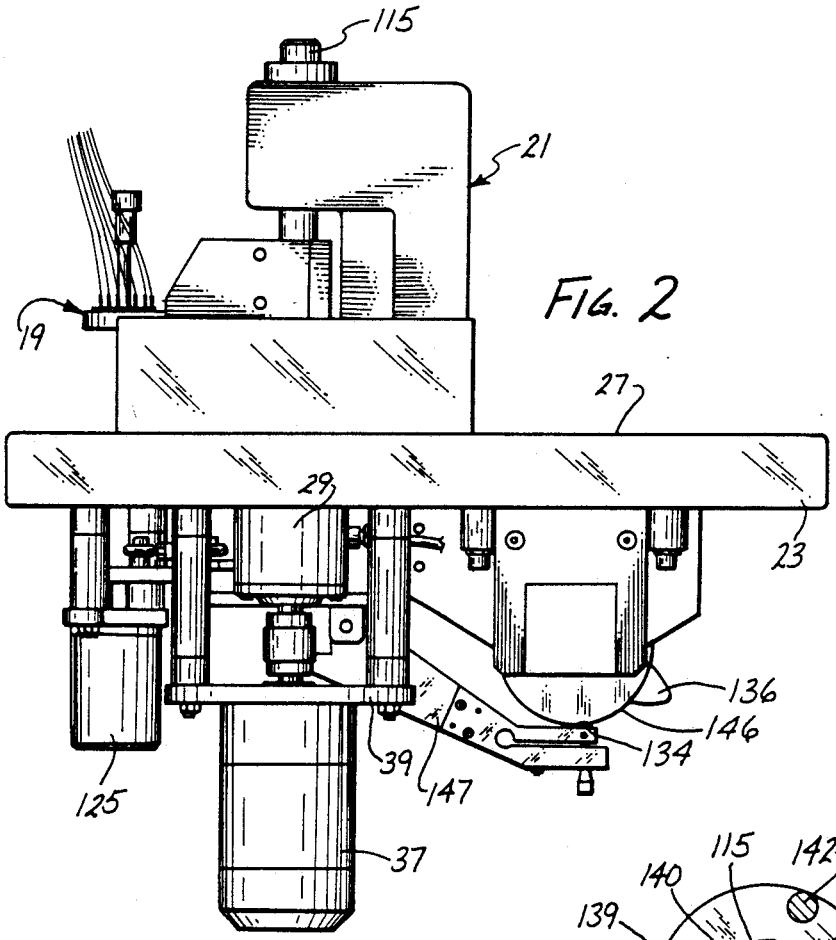
FIG. 2 is an end elevational view of the machine with the fixture arm rotated 90 degrees from the position shown in FIG. 1 to the cleaning position.

Next, the operator grasps the fixture 19, elevates the shaft 115 to remove the pin 135 from the slot 137 and rotates the shaft 90 degrees clockwise as viewed in FIG. 6 to place the pin 135 in the slot 132. When so positioned, the fixture 19 projects outwardly from the fixture housing 113 intermediate the grinding station 15 and the polishing station 17 as shown in FIG. 2.

After the cleaning operation is completed, the operator pivots the fixture 19 and the shaft 115 to place the pin 135 in the slot 139, and when so positioned, the fixture 19 is above the polishing station 17. Thereafter, the motor 145 is manually started whereupon the continued rotation of the polishing cam 146' allows its lobe 136 to let the fixture descend toward the disc **59*a* of the polishing station 17. Thereafter during the polishing operation, the roller 134' engages the polishing cam 146, so that the polishing cam 146' controls the rate of feed. It should be noted that the slots 137 and 139 are deep enough axially to allow a good driving connection between the pin 135 and the collar 133 as the fixture 19** is fed toward either the grinding or polishing abrasives.

The cams 146 and 146' can be configured to bring about the desired vertical movement of the shaft 115 and the fixture 19. One preferred configuration for each of the cams 146 and 146' is set forth in the two tables below: T,190

Figure 8:
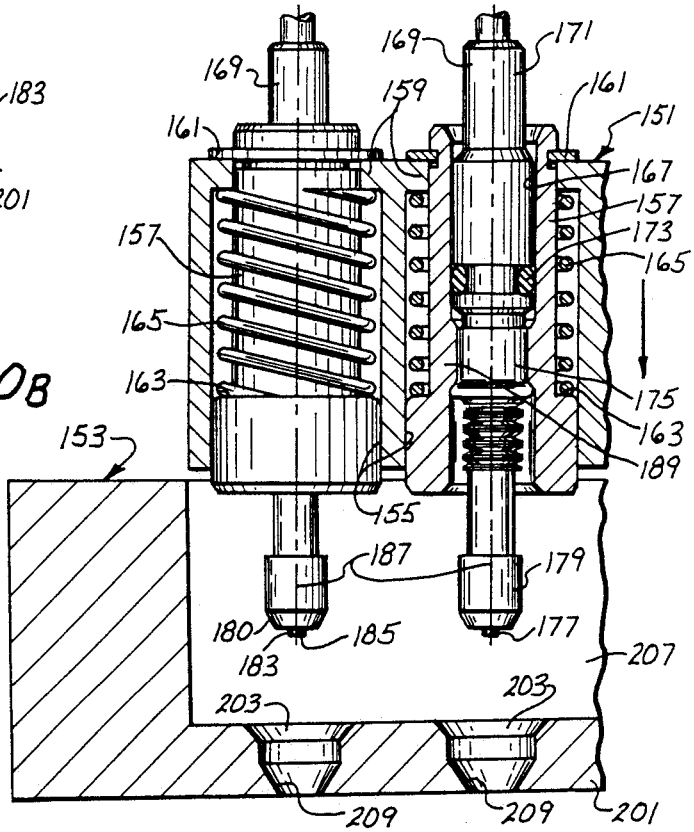
FIG. 8 is an enlarged fragmentary sectional view illustrating a portion of the fixture, with the first fixture member and the fiber optic termini being inserted into the second fixture member.
Figure 9:
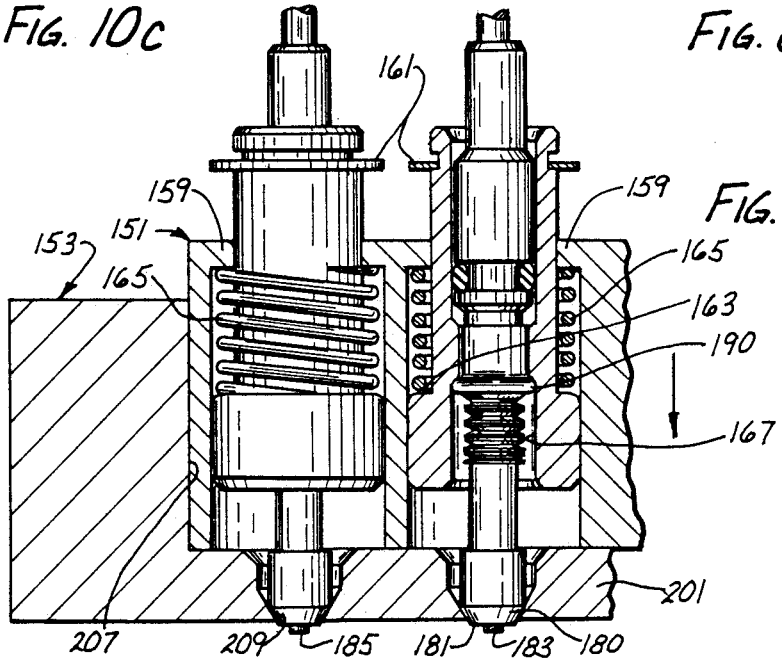
FIG. 9 is a fragmentary sectional view similar to FIG. 8 with the first fixture member fully received within the second fixture member.

The fixture 19 includes a first fixture member or terminus holder 151 and a second fixture member or fixture arm 153 (FIGS. 1, 8 and 9). The terminus holder 151 has a plurality of passages 155 and includes a corresponding number of sleeves 157 mounted in the passages 155, respectively, for axial sliding movement. The sleeves 157 are retained within the passages 155 by annular flanges 159 surrounding the upper ends of the passages 155, respectively, which cooperate with retainers 161 and shoulders 163 on the sleeves 157, respectively. Resilient means in the form of coil compression springs 165 act between the associated flanges 159 and shoulders 163 to resiliently bias the sleeves 157 downwardly as viewed in FIGS. 8 and 9.

Each of the sleeves 157 has a passage 167 extending axially through it, and this passage is adapted to receive a fiber optic terminus 169 as shown in FIGS. 8 and 9. The fiber optic termini 169 may be identical and of conventional construction. For example, each of the fiber optic termini 169 may include a housing 171, a seal 173 surrounding the housing, a retainer 175 mounted on the housing, and an optical fiber 177 extending completely through the housing. The housing 171 includes a bushing 179 having a radially tapered or conical surface 180 and an end face 181, which forms the distal end of the terminus 169. The optical fiber 177 extends axially completely through the housing 171, and a projecting segment 183 extends beyond the end face 181 and terminates in a distal end 185. The optical fiber 177 has a longitudinal axis 187, and the end face 181 and the distal end 185 should be completely flat, flush and perpendicular to the axis 187. Fiber optic termini of this type are known, and the termini 169 may be, for example, of the type shown and described in common assignee's copending application Ser. No. 091,932 filed Sep. 1, 1987, which is incorporated by reference herein.

The terminus holder 151 has means for releasably retaining the termini 169 in the associated passages 167. Although such means may be of various different constructions, in the illustrated embodiment, it includes an annular internal rib 189 in each of the passages 167 for cooperating with the retainer 175 to releasably retain the termini 169 in the associated passages 167. In the position of FIG. 9, an annular flange 190 is held against the rib 189 by the spring 165 and the fixture arm 153.

Figures 4, 7:
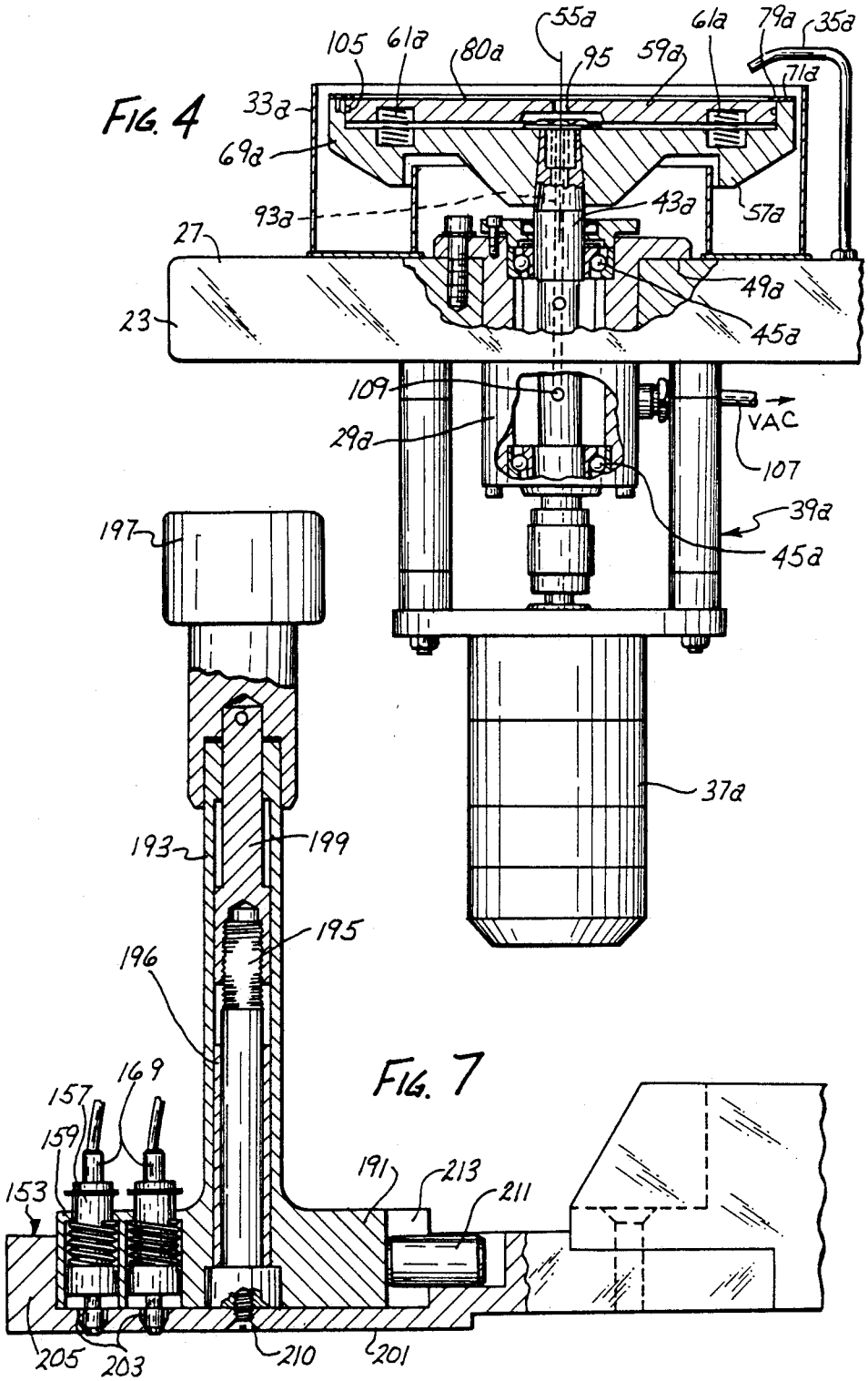
FIG. 4 is a sectional view taken generally along line 4—4 of FIG. 1 and illustrating the polishing section of the machine.
FIG. 7 is a sectional view taken generally along line 7—7 of FIG. 1 and illustrating the fixture.

With reference to FIG. 7, the terminus holder 151 has a main body 191 in which the sleeves 157 are retained and a central hollow stem 193 integral with, and projecting upwardly from, the main body. A screw 195 is fixedly retained within the main body 191 and projects upwardly into the stem 193, and a sleeve 196 is pressed onto the screw. A knob 197 is drivingly coupled to an elongated nut 199 which receives an end portion of the screw 195. Accordingly, by rotating the knob 197 and holding the main body 191 against rotation, the stem 193 and the main body 191 can be moved downwardly relative to the screw 195.

The fixture arm 153 (FIGS. 1 and 7–9) includes an end wall 201 having a plurality of passages 203 extending axially through it and an integral peripheral wall 205, which cooperates with the end wall to define an open-topped recess 207. Each of the passages 203 has a conically tapered surface 209 which is of progressively decreasing diameter as it extends downwardly as viewed in FIG. 8. A screw 210 (FIG. 7) fixedly mounts the screw 195 on the end wall 201.

The recess 207 is adapted to receive the terminus holder 151 as shown in FIGS. 7 and 9, with the passages 203 being in registry with the passages 167, respectively. Accordingly, as shown in FIG. 8, the termini 169 project substantially beyond the lower ends of the sleeves 157. The terminus holder 151 can be releasably mounted on the fixture arm 153 and held against rotation relative to the fixture arm in various different ways, such as by a pin 211 (FIG. 7) fixedly attached to the fixture arm and slidably receivable in a slot 213 of the terminus holder. When so mounted, the termini 169 project from the wall 201 such that the distal ends 185 of the optical fibers 177 are spaced from the wall 201 (FIGS. 9 and 10A), and the projecting segments 183 of the optical fibers 177 extend beyond the wall 201. In addition, the end faces 181 are spaced outwardly from the wall 201, i.e., are spaced downwardly from the wall. In this position, the radially tapered surfaces 180 of the termini 169 engage and are supported by the tapered surfaces 209, respectively, of the wall 201. By rotating the knob 197 when the slot 213 receives the pin 211, the flanges 159 force the springs 165 downwardly to compress them against the associated shoulders 163 to thereby bias the termini against the tapered surfaces 209. In this position, the terminus holder 151 is tightly retained in the fixture arm 153, and the termini 169 are ready for grinding.

Figure 10A:
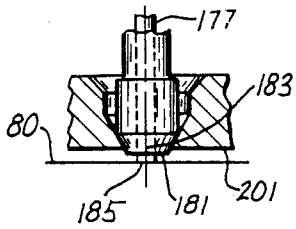
FIGS. 10*a–c* show how the fiber optic termini space the fixture from the abrasive during both grinding and polishing and how the grinding and polishing operations progressively finish and smooth the end of the terminus.
Figure 10B:
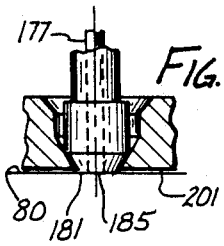

To carry out the grinding operation, the motor 37 is energized to rotate the disc 59, and the motor 145 and cam 146 move the fixture 19 downwardly to bring the distal ends 185 into contact with the grinding abrasive 80 as shown in FIG. 10A. The motor 145 and cam 146 also control the rate of feed, i.e., the rate at which the fixture 19 is moved downwardly against the grinding abrasive 80. In addition, the motor 125 causes the fixture 19 to oscillate about the axis 111 to move the distal ends 185 in an arcuate path along the rotating abrasive 80. During this time, the projecting segments 183 prevent contact between the wall 201 and the grinding abrasive 80. The grinding operation may proceed until the projecting segment 183 is completely ground off as shown in FIG. 10B. The grinding operation may continue further to grind off a small amount of material from the end face 181. Because the end face 181 is spaced outwardly from the wall 201 during this phase of the grinding operation, the end face 181 prevents the wall 201 from contacting the abrasive surface 80.

When the grinding operation has been completed, the motor 125 stops automatically to terminate oscillation of the fixture 19, and the motor 145 and cam 146 elevate the fixture to raise the end faces 181 off the grinding abrasive 80 as described above. The fixture 19 is manually pivoted about the axis 111 to place the pin 135 in the slot 132 and the fixture 19 in the cleaning position shown in FIG. 2 in which the fixture 19 is intermediate the grinding station 15 and the polishing station 17. This enables the fixture 19, the end faces 181 and the distal ends 185 to be manually cleaned before they are moved to the polishing station 17.

Figure 10C:
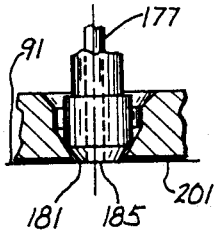

Next, the fixture 19 is manually raised and pivoted 90 degrees so as to place the pin 135 (FIG. 6) in the slot 139 and to place the fixture 19 over the polishing abrasive 91. By manually restarting of the motor 145 (FIG. 5), the cam 146 allows the fixture 19 to descend in the manner described above with respect to the grinding operation whereupon the operation described above with respect to grinding is repeated. However, during the polishing operation, much less material is removed, and the result, as shown in FIG. 10C, is that both the end face 181 and the distal end 185 are provided with an optical finish. During the polishing operation, subatmospheric pressure is applied to the grooves 99 and 103 to retain the polishing abrasive 91 in position, and during both grinding and polishing, appropriate lubricant may be provided to the respective abrasive surfaces through the nozzles 35 and **35*a*. At the end of the polishing operation, the lobe 138 raises the fixture 19 and the termini 169 off the polishing abrasive 91 and the motor 125 stops automatically. The ground and polished termini 169 are then removed from the fixture 19 and replaced with a set of unground termini whereupon the grinding and polishing operation described above is repeated. During the grinding and polishing operations, the end wall 201 of the fixture 19 and the distal ends 185 of the fibers 177 are held parallel to the grinding abrasive 80 and the polishing abrasive 91** by virtue of the accurately lapped and machined construction described above.

The sequencing of the operations of the motors to bring about rotation of the grinding abrasive 80 and the polishing abrasive 91, and the axial and oscillatory movement of the fixture 19 can be brought about in any suitable manner, such as with relays, a logic circuit, or utilizing appropriate software.

Although an exemplary embodiment of the invention has been shown an described, many changes, modifications and substitutions may be made by one having ordinary skill in the art without necessarily departing from the spirit and scope of this invention.

What is claimed is:

1. A method of making a grinding and polishing machine for fiber optic termini comprising:

providing a base member having a lapped surface;

providing grinding and polishing bearing assemblies with each of said bearing assemblies including a housing, a shaft, and bearing means for mounting the shaft on the housing for rotational movement;

rotating the housing of the first bearing assembly about a rotational axis defined by the shaft of the first bearing assembly and machining a face of the housing during such rotation so that the face is perpendicular to the rotational axis;

rotating the housing of the second bearing assembly about a second rotational axis defined by the shaft of the second bearing assembly and machining a face of the housing of the second bearing assembly during such rotation so that the face of the housing of the second bearing assembly is substantially perpendicular to the second rotational axis;

attaching a platen to the shaft of the first bearing assembly and rotating the shaft and the platen of the first bearing assembly together while machining a mounting surface of the platen of the first bearing assembly such that the mounting surface is perpendicular to the rotational axis of the shaft of the first bearing assembly;

attaching a platen to the shaft of the second bearing assembly, said platens being adapted to carry abrasives, respectively; and placing the faces against the lapped surface and attaching the first and second bearing assemblies to the base member whereby both of the rotational axes are perpendicular to the lapped surface.

2. A method as defined in claim 1 including rotating the shaft and the platen of the second bearing assembly together while machining a mounting surface of the platen of the second bearing assembly such that the mounting surface of the second bearing assembly is perpendicular to the rotational axis of the shaft of the second bearing assembly.

3. A method as defined in claim 2 including providing a fixture bearing assembly which includes a fixture arm housing, a fixture arm shaft and bearing means for mounting the fixture arm shaft on the fixture arm housing for oscillatory movement, rotating the fixture arm housing of the fixture bearing assembly about an oscillatory axis defined by the fixture arm shaft and machining a face of the fixture arm housing during such rotation so that said face is perpendicular to the oscillatory axis, placing the face of the fixture arm housing against the lapped surface and attaching the fixture bearing assembly to the base member whereby the oscillatory axis is perpendicular to the lapped surface.

* * * * *